US006338701B1

(12) United States Patent
Webber

(10) Patent No.: US 6,338,701 B1
(45) Date of Patent: Jan. 15, 2002

(54) CABLE AND PULEY LINKAGE FOR EXERCISE MACHINE

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 0 days.

(21) Appl. No.: 09/434,414

(22) Filed: Nov. 4, 1999

Related U.S. Application Data

(63) Continuation-in-part of application No. 09/365,139, filed on Jul. 30, 1999, which is a continuation of application No. 08/977,189, filed on Nov. 24, 1997, now Pat. No. 5,951,444.

(51) Int. Cl.[7] ..... A63B 21/00
(52) U.S. Cl. ..... 482/99; 482/138
(58) Field of Search ..... 482/92, 94–103, 482/112, 113, 120, 129, 130, 133, 135–138; D21/673, 675, 676; 254/337, 393, 399

(56) References Cited

U.S. PATENT DOCUMENTS 5,211,614 A * 5/1993 Henes ..... 482/100
RE34,572 E * 3/1994 Johnson et al. ..... 482/138
5,316,534 A * 5/1994 Dalebout et al. ..... 482/138

* cited by examiner

*Primary Examiner*—John Mulcahy
(74) *Attorney, Agent, or Firm*—Brown, Martin, Haller & McClain, LLP

(57) ABSTRACT

A cable and pulley assembly has a first floating pulley unit having a pulley housing and a pair of pulleys rotatably mounted side-by-side in the housing for rotation about a single pulley axis, and a second floating pulley unit having a pulley housing and at least one pulley rotatably mounted in the housing. A first cable is linked to the housing of the first floating pulley unit, and a second cable is linked to the housing of the second floating pulley unit. A third cable extends around one of the side-by-side pulleys in the first pulley unit, around the pulley of the second pulley unit, and around the other side-by-side pulley of the first pulley unit. The resistance on the first cable is then four times that on each section of the third cable, and plural pull points are provided for selective connection to exercise stations.

45 Claims, 7 Drawing Sheets

WEIGHT STACK
100%
18
19
100%
16
10
14
12
20
200%

WS
100%
27
28
100%
26
21
24
22
25
28
100%
100%

WS
100%
35
34
32
30
31
33
36
300%

WS 100%
12
10
10
14
38
50%
50%
12
100%
12
100%

WS 100%
26
22
21
24
10
100%
100%
12
200%
12
200%

WS 100%
100%
16
10
100%
16
10
100%
16
10
12
400%

CABLE AND PULEY LINKAGE FOR EXERCISE MACHINE

CROSS REFERENCE TO RELATED APPLICATIONS

This application is a Continuation-In-Part of Application Ser. No. 09/365,139 filed Jul. 30, 1999, which is a Continuation of application Ser. No. 08/977,189 filed Nov. 24, 1997 now U.S. Pat. No. 5,951,444.

BACKGROUND OF THE INVENTION

The present invention relates generally to weight lifting exercise machines, and is particularly concerned with a cable and pulley linkage apparatus for coupling a load to various exercise stations in such a machine.

A typical exercise or weight machine has a support frame, a load such as a weight stack mounted on the frame, and various different exercise stations linked to the load, usually by means of a cable and pulley system consisting of a series of fixed and floating pulleys around which one or more cables extend. Such a machine is described in my U.S. Pat. No. 5,236,406, for example, the contents of which are incorporated herein by reference.

One problem with existing cable and pulley linkages is that a large number of pulleys is required to link a weight stack to several exercise stations, and the more pulleys you provide, the greater the space that is required. Additionally, there is a limit to the resistance ratio and the number of pulling points which can be achieved with current floating pulley arrangements. A 3 to 1 resistance ratio is the maximum which can be achieved in most current systems.

SUMMARY OF THE INVENTION

It is an objective of the present invention to provide a new and improved cable and pulley linkage system for weight lighting exercise machines.

According to one aspect of the present invention, a cable and pulley linkage system is provided, which comprises a floating double pulley having a support bracket and a pair of pulleys rotatably mounted on the same pivot axis on the support bracket in a side-by-side arrangement, a second floating pulley having at least one pulley, a first cable secured to the second floating pulley providing a first pulling point, a second cable secured to the double floating pulley providing a second pulling point, and a third cable extending around the single and double floating pulleys and providing third and fourth pulling points, whereby the system has at least four pulling points for selective linking to a load and exercise stations.

In one possible arrangement, the first cable is linked to a load such as a weight stack (100% load), the second cable is linked to a first exercise station, and the third cable extends around one of the pair of floating pulleys, then around the single floating pulley, and finally around the other of the pair of floating pulleys, providing two pulling points which may both be connected to exercise stations, or to one exercise station and one fixed point or cable tie-off, or to two cable tie-offs. In each case, the first exercise station has a 2 to 1 resistance ratio (200% of load), and the third cable has a 50% load at one or both ends.

In an alternative embodiment, a third pulley is secured to the double pulley support bracket beneath the pair of pulleys. In this case, the second cable extends around the third pulley to provide two pulling points at 100% of load each. These may both be connected to exercise stations, or one may be connected to a fixed cable tie-off.

The second floating pulley assembly may be a single pulley, or alternatively may comprise a pair of vertically aligned pulleys. In this case, the first cable extends around the uppermost pulley of the pair to provide two pulling points, one of which may be linked to the load or weight stack. This arrangement provides a 4 to 1 resistance ratio between the first cable and the second cable, where the first floating pulley assembly has a double pulley only. Alternatively, where a third pulley is mounted on the first floating pulley assembly, two pulling points at a 2 to 1 resistance ratio are provided. At the same time, the third cable in this arrangement provides two pulling points at 100% of load, or 1 to 1, and the first cable provides a third 100% pulling point.

According to another aspect of the present invention, a cable and pulley assembly is provided which comprises at least one floating pulley unit having a pulley housing and a pair of pulleys rotatably mounted side-by-side in the housing for rotation about a first pulley axis, a first cable linked to the pulley housing, a second cable extending around the pair of side by side pulleys and having opposite ends, and the resistance on the first cable being four times that at one end of the second cable.

In one alternative, the first cable is connected to the pulley housing at one end and has a resistance of four times that at one end of the second cable. In another alternative, a third pulley is rotatably mounted on the first pulley unit housing for rotation about a second pulley axis spaced from the first pulley axis, and the first cable extends around the third pulley and has opposite ends, the resistance at each end of the first cable being twice that at one end of the second cable. The third pulley axis is preferably perpendicular to the first pulley axis.

Each cable end may be selectively linked to an exercise resistance, a cable tie-off, or an exercise station. In some embodiments, a second floating pulley unit having a housing and a third pulley rotatably mounted in the housing is linked to the first floating pulley unit. The second cable extends around the third pulley, and a third cable is linked to the second pulley unit housing and to an exercise resistance, tie-off, or exercise station. The third cable may extend around a pulley rotatably mounted on the exercise resistance or weight stack, so that the end of the third cable may also be linked to an additional exercise station. In another alternative, the second cable extends from one of the side-by-side pulleys in a cable path extending around a pulley rotatably mounted on the weight stack or exercise resistance, and then back around the other of the side-by-side pulleys, so that the same cable links the first floating pulley unit to the load and still has opposite ends free for linking or connecting to different exercise stations.

This system permits five or more exercise stations to be linked to a resistance or load with a cable and pulley system where the pulleys are in line, on top of one another, rather than spreading out sideways as was necessary in the past. It therefore takes up much less space on the frame. Also, much fewer pulleys and pulley support brackets are required, and the streamlined design will enhance the appearance of the overall machine. The ability to provide two 2 to 1 resistance cables in one floating pulley was also not an option in previous systems.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

FIGS. 1A to 1F illustrate the capabilities of some of the prior art pulley and cable systems, so that they may be compared to the cable and pulley systems of this invention as illustrated in FIGS. 2 to 18.

Figures 1, 1A, 1B, 1C, 1D, 1E, 1F:
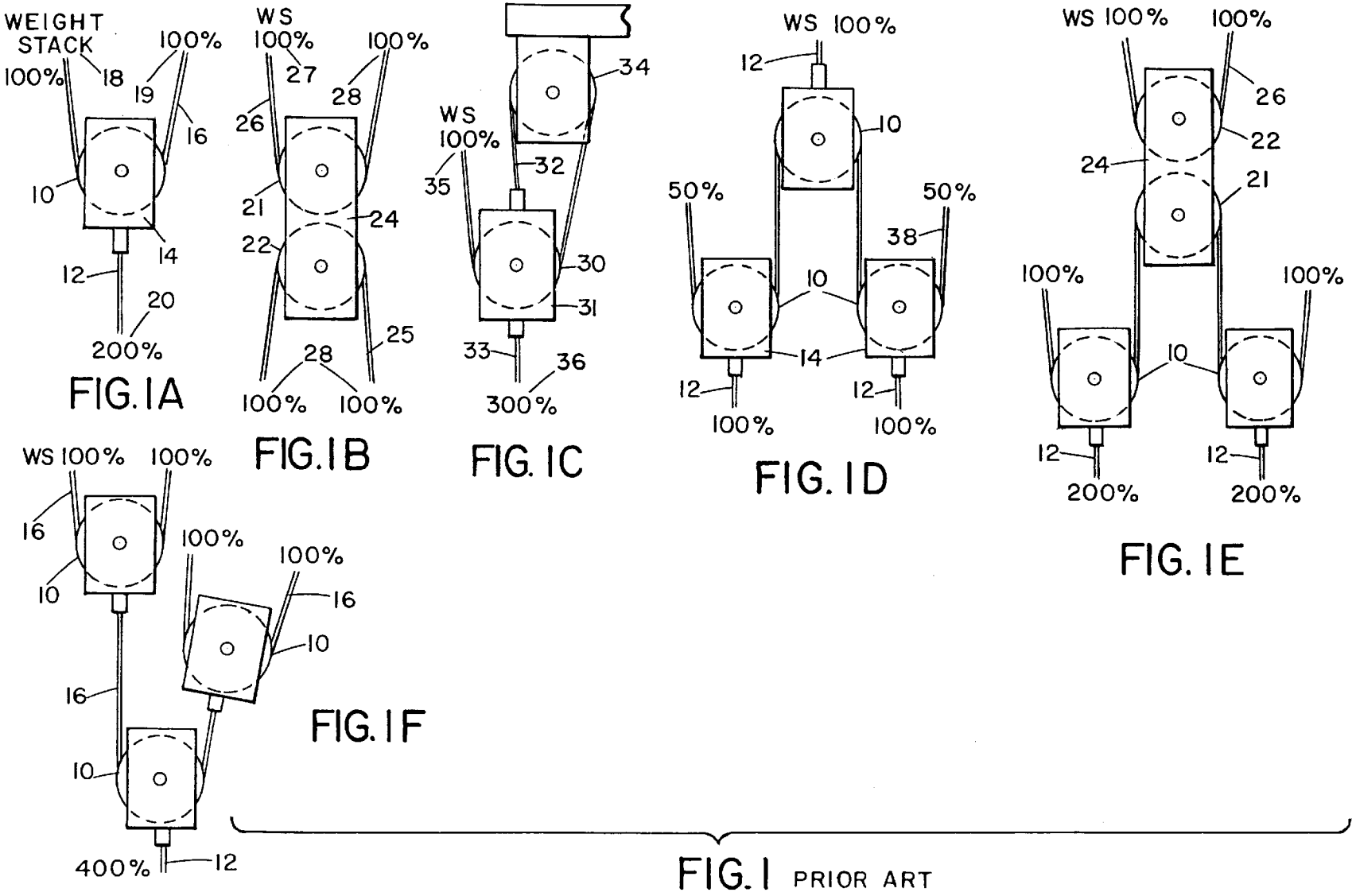
FIG. 1 PRIOR ART
FIGS. 1A to 1C illustrate three basic prior art floating pulleys used in prior art cable and pulley systems.
FIGS. 1D to 1F illustrate various prior art cable and pulley systems using these floating pulleys.

FIG. 1A illustrates a simple, prior art single floating pulley 10 with a first cable 12 linked to the pulley housing 14 and a second cable 16 extending around the pulley. This arrangement provides one weight stack or load connection point 18 and two possible exercise pulling points 19,20, one at a 100% or 1:1 resistance ratio, and one at a 200% or 2:1 resistance ratio. The single floating pulley may be reversed, with point 20 attached to the load and points 18,19 providing two 50% or 1:2 resistance ratios.

In FIG. 1B, a prior art double floating pulley is illustrated in which two pulleys 21,22 are stacked vertically one on top of the other in pulley housing 24. In this case, a first cable 25 extends around one of the pulleys and a second cable 26 extends around the other pulley, providing one weight stack or load attachment 27 and three 100% or 1:1 pulling points 28.

FIG. 1C illustrates another prior art floating pulley arrangement. In this arrangement, a single floating pulley 30 is mounted in a housing 31 to which two, oppositely directed cables 32,33 are secured. One of the cables 32 extends around a fixed pulley 34, then back around the single floating pulley 30. If the free end 35 of this cable is secured to the load or weight stack, the pulling point 36 on cable 33 has a 300% or 3:1 resistance ratio.

Thus, existing floating pulleys can provide resistance ratios of 1:2 (50% of load), 1:1 (100% of load), 2:1 (200% of load), and 3:1 (300% of load).

FIGS. 1D to 1F illustrate some prior art cable and pulley systems using combinations of these floating pulleys. FIG. 1D illustrates a combination of three single floating pulleys 10 in which each pulley has a single cable 12 connected to housing 14, and a cable 38 extends around all three pulleys 10. If the central cable 12 is connected to the weight stack, the opposite ends of cable 38 provides two 50% pulling points, while each of the other two cables 12 provide a 100% pulling point.

In FIG. 1E, a combination of two single floating pulleys 10 and a double floating pulley 21,22 is illustrated. In this case, the cable 25 extending around the lowermost pulley 21 of the double floating pulley has opposite ends extending around respective single floating pulleys 10. In this combination, one end of cable 26, for example, can be connected to the weight stack, providing a 100% pulling point at the opposite end of cable 26 as well as at each end of cable 25. Each cable 12 will provide a 200% pulling point.

FIG. 1F illustrates an alternative arrangement of three single floating pulleys 10 to provide three 100% pulling points and one 400% pulling point.

In each of these floating pulley combinations, the floating pulleys spread out sideways to increase the number of pulling points, considerably increasing space requirements. Additionally, at least three floating pulleys and pulley housings are needed to provide four pulling points, and additional floating pulleys must be provided for additional exercise stations, thus the system spreads out sideways even more in such arrangements, increasing space requirements.

Figure 2:
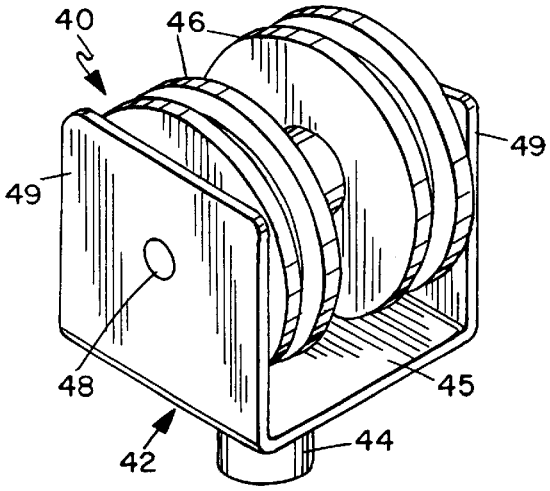
FIG. 2 is a perspective view of a double floating pulley assembly forming part of some embodiments of the cable and pulley system of this invention.
Figure 3:
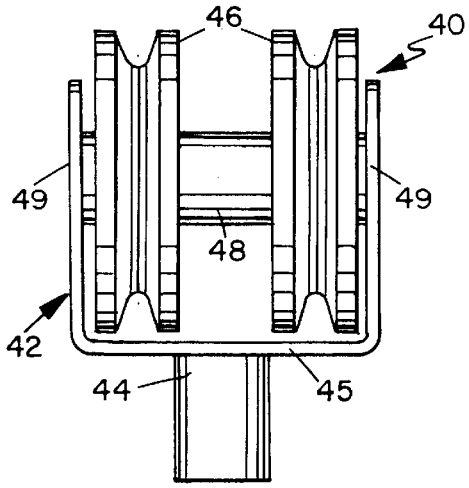
FIG. 3 is an end elevational view of the pulley assembly of FIG. 2.
Figure 4:
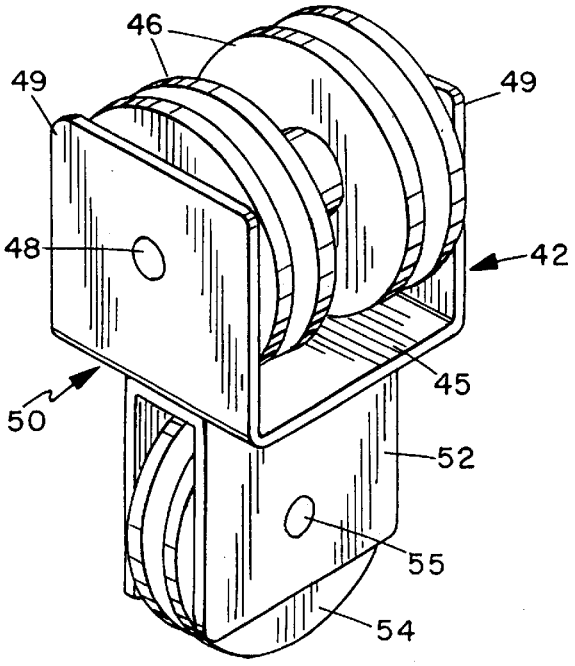
FIG. 4 is a perspective view of a triple floating pulley assembly according to another embodiment of the invention.

FIGS. 2 to 4 of the drawings illustrate two alternative floating side-by-side pulley units 40,50, respectively, of the present invention which are at the heart of each of the alternative embodiments of the cable and pulley linkage of the invention as illustrated in FIGS. 5 to 18. FIGS. 2 and 3 illustrate a double floating pulley unit 40 according to a first embodiment and FIG. 4 illustrates a triple floating pulley unit 50 according to a second embodiment of the invention. The double floating pulley unit 40 basically comprises a generally U-shaped pulley housing 42 having a cable tie-off 44 extending from its base wall 45. A pair of side-by-side pulleys 46 are rotatably mounted on a single pulley axle 48 extending between the side walls 49 of the pulley housing. This pulley device is used in the cable and pulley linkage systems of FIGS. 5,8,9,11 and 12 to 17.

The triple floating pulley unit 50 illustrated in FIG. 4 is a modification of the double floating pulley device of FIGS. 2 and 3, and like reference numerals are used for like parts as appropriate. However, the cable tie-off 44 is replaced with a single pulley housing 52 in which a single pulley 54 is rotatably mounted for rotation about an axis 55 perpendicular to the double pulley axle or axis 48.

The double and triple floating pulley units of FIGS. 2 to 4 may be used in a number of different configurations to produce a more versatile and compact pulley and cable linkage for a multiple station, weight lifting exercise machine. Some of these alternatives are illustrated in FIGS. 5 to 18. In these embodiments, like reference numerals have been used for like parts as appropriate. In each of these embodiments, any cable end may selectively be attached to the frame of an exercise machine, attach to a single floating pulley, or continue on to an exercise station.

Figure 5:
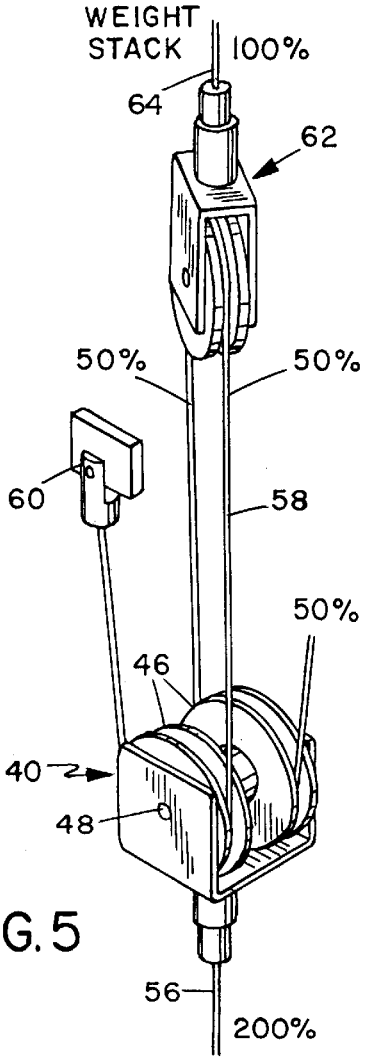
FIG. 5 is a perspective view of a first cable and pulley system according to one embodiment of the invention using the double pulley assembly of FIGS. 2 and 3.

One possible linkage using the double floating pulley unit 40 is illustrated in FIG. 5. In this linkage, a first cable 56 is secured to the cable tie-off 44 and a second cable 58 extends from a fixed point or tie off 60 on the frame, or a movable arm, around a first one of the pair of pulleys 46, then around a single floating pulley 62 positioned above the double pulley unit 40, and finally back around the second one of the pulleys 46. The free ends of cables 56 and 58 can be connected to different exercise stations, while a third cable 64 connects the single pulley unit 62 to a load such as a weight stack. A 1:2 or 50% resistance is thus provided at the end of cable 58, while a 2:1 or 200% resistance is provided at the end of cable 56. The cable 56 thus has a resistance four times that at each end of cable 58.

The arrangement of FIG. 5 may be connected in different configurations. For example, both ends of cable 58 may be connected or linked by additional pulleys to exercise stations, providing two 50% pull points as well as the 200% pull point. In another alternative, both ends of cable 58 may be connected to fixed points on the frame, or tie-offs 60, providing a single 2:1 or 200% exercise pull point. Alternatively, tie-offs 60 may be on one or more movable arms.

Figure 6:
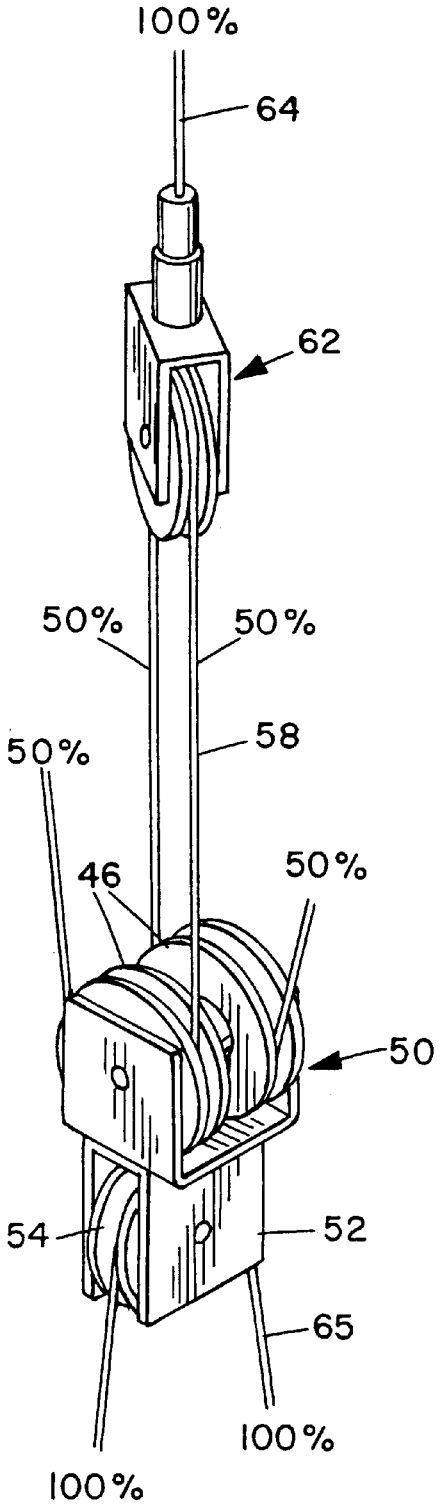
FIG. 6 is a perspective view of a second cable and pulley system according to another embodiment of the invention, using the triple pulley assembly of FIG. 4.

FIG. 6 illustrates another possible cable and pulley linkage which uses the triple floating pulley unit 50 in combination with a single floating pulley 62 as in the previous embodiment. A first cable 65 extends around the lower, single pulley 54 of unit 50, while the cable 58 is arranged as in the previous embodiment, extending around one of the two pulleys 46, then around the single pulley 62, and then back down around the second of the pulleys 46. In the illustrated embodiment, both ends of cable 58 are connected to exercise stations, cable 64 is connected to the weight stack, and both ends of cable 65 are also connected to exercise stations, providing four pull points in an in-line arrangement. Each end of cable 58 will have a 1:2 or 50% resistance while each end of cable 65 has a 1:1 or 100% resistance.

Figure 7:
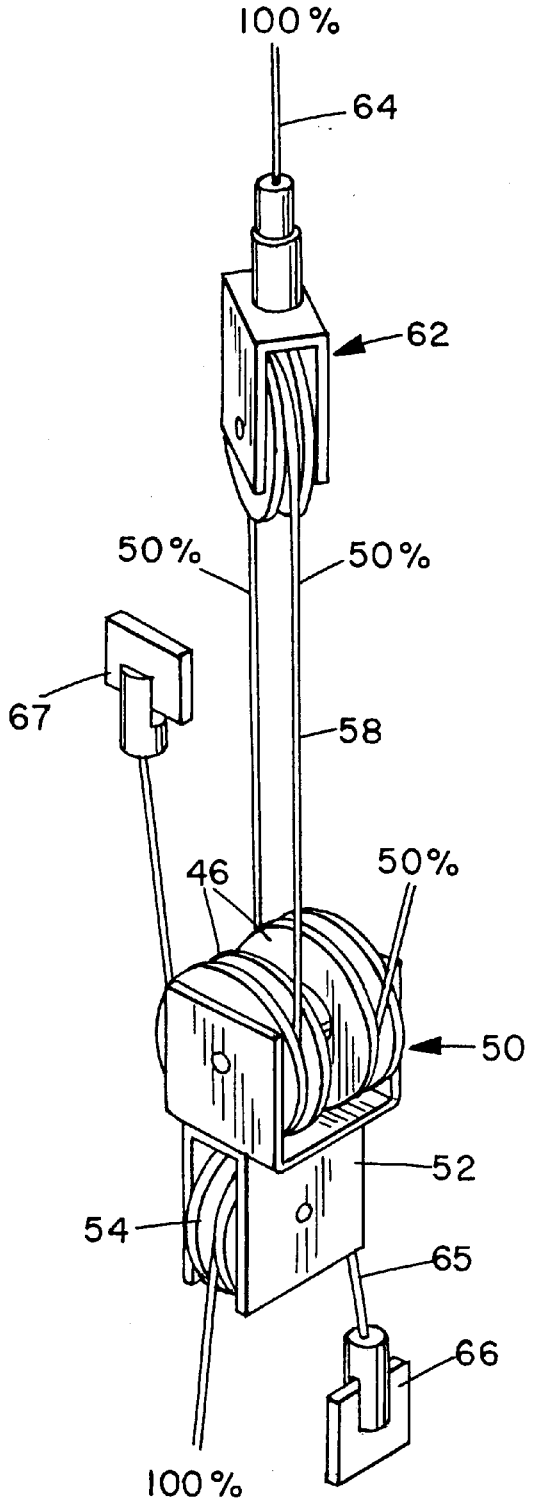
FIG. 7 is a perspective view illustrating a modification of the system of FIG. 6.

The cables in FIG. 6 can also be connected differently to provide different combinations of pull points. For example, one or both ends of cable 58 may be connected to fixed tie-offs or movable arms, if a reduced number of exercise stations are involved. FIG. 7 illustrates another alternative in which one end of cable 65 is connected to a fixed tie-off or movable arm 66, and one end of cable 58 is also connected to a fixed tie-off or movable arm 67, so that the opposite ends of cables 65 and 58 can be used as 100% and 50% pull points, respectively, at different exercise stations. In this case there are only two exercise stations. Alternatively, both ends of cable 58 may be connected to exercise stations, providing three pull points or exercise station connections, two at 50% and one at 100%.

Figure 8:
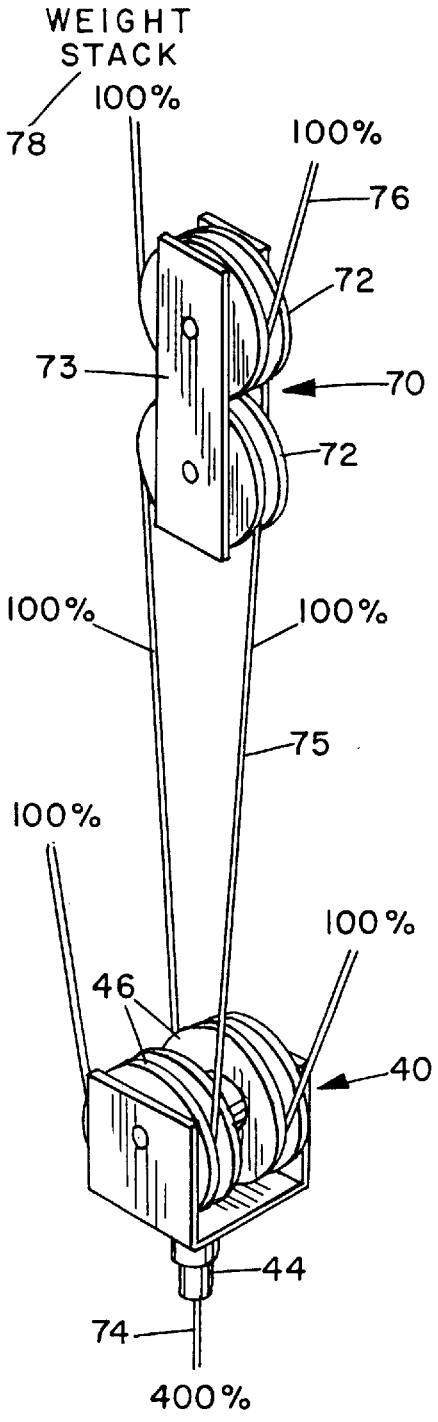
FIG. 8 is a perspective view of a third cable and pulley system utilizing the double pulley assembly of FIGS. 2 and 3.

FIG. 8 illustrates another alternative cable and pulley assembly using the double floating pulley unit 40 of FIGS. 2 and 3 in combination with a double floating pulley unit 70 which has two pulleys 72 positioned in a vertically spaced configuration, with the pulleys in line on top of one another, in a pulley housing 73. The vertically stacked double pulley unit 70 is spaced above the side-by-side floating pulley unit 40. A first cable 74 is connected to the tie-off 44 at the bottom of unit 40. A second cable 75 extends around one of the two pulleys 46, then around the lowermost of the pulleys 72, and then back around the other of the two pulleys 46. A third cable 76 extends around the uppermost pulley 72 of unit 70. In this assembly, one end 78 of cable 76 is preferably connected to the load or weight stack. The other four cable ends may be connected to exercise stations, if desired. The other end of cable 76 and both ends of cable 75 each have a 1:1 resistance ratio, or 100% of load, as indicated in the drawing. The end of cable 74 will have a 4:1 resistance ratio, i.e. 400% of load. Therefore, this cable and pulley assembly increases the resistance of an incoming, load-bearing cable by four times, in a compact, in line arrangement, which was not possible in any prior art cable and pulley systems.

Instead of connecting both ends of cable 75 to exercise stations, as in FIG. 8, one or both ends of cable 75 may be connected to a fixed tie-off point or bracket on the support frame of the exercise machine, if fewer exercise stations are used, or to a moveable arm, or to additional pulleys.

Figure 9:
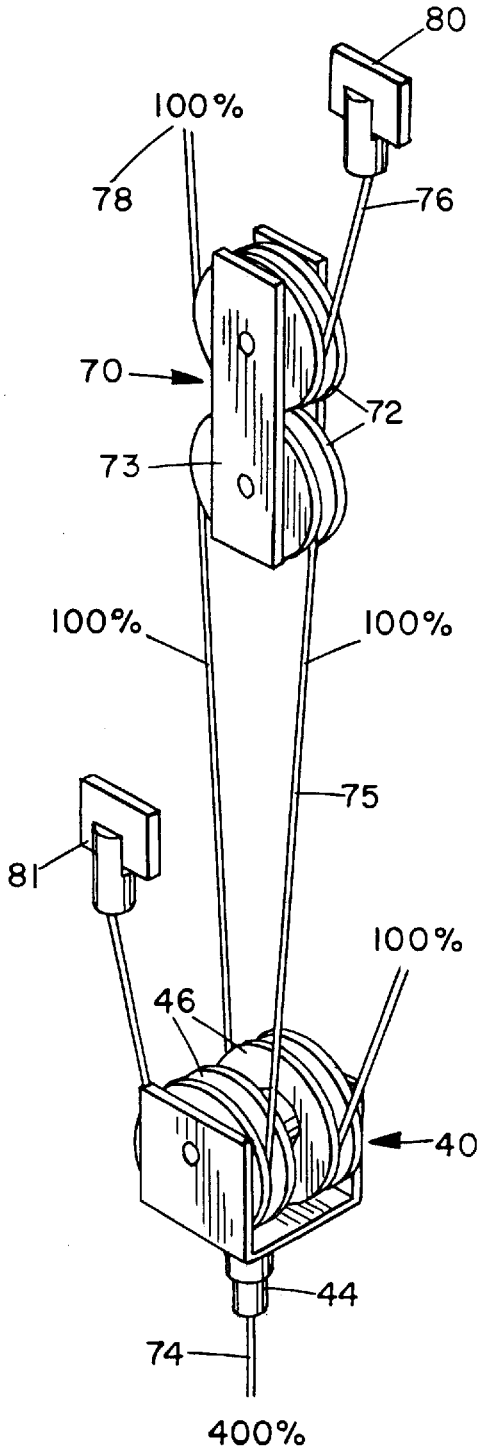
FIG. 9 is a perspective view illustrating a modification of the system of FIG. 8.

FIG. 9 illustrates another modification of the assembly of FIG. 8, in which the opposite end of cable 76 to the load is connected to a fixed tie-off or bracket 80, and one end of cable 75 is also connected to a fixed tie-off or bracket 81. In each of these alternatives, the lower cable 74 still has a 4:1 resistance ratio, or 400% of load, and two or three additional pull points at 100% are provided.

Figure 10:
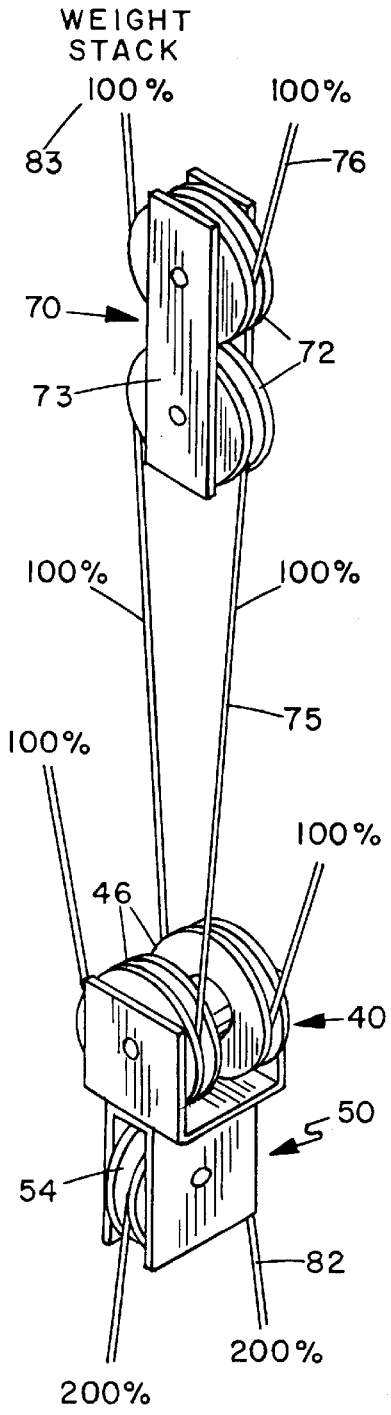
FIG. 10 is a perspective view of a cable and pulley system according to another embodiment of the invention, using the triple pulley assembly of FIG. 4.

FIG. 10 illustrates another modified cable and pulley assembly which uses a double, vertically stacked floating pulley 70 as in FIG. 8 and 9, but in combination with the triple floating pulley unit 50 rather than the double pulley unit 40. As in the previous embodiment, upper cable 76 extends around the uppermost pulley 72, and a cable 75 connects the lowermost pulley 72 to the side by side pulleys 46 of pulley unit 50. As in the previous embodiment, cable 75 extends around one of the pulleys 46, lowermost pulley 72, and then around the other pulley 46. A cable 82 extends around the lower pulley 54 of the triple pulley unit 50. One end 83 of cable 76 may be connected to the load or weight stack, and up to five exercise stations may be connected to the other cable ends, i.e. the opposite end of cable 76 and each end of the cables 75 and 82.

In this arrangement, the free end of cable 76 has a 1:1 resistance ratio, or 100% of load, as do the opposite ends of cable 75. The opposite ends of the lowermost cable 82 each have a 2:1 resistance ratio, or 200% of load. This assembly provides pull points for up to five exercise stations in a simple, in line arrangement, whereas in the past such a large number of exercise stations would have required a cable and pulley system which extended sideways and took up much more room than the illustrated assembly.

There are a number of possible configurations for the cable ends of the assembly of FIG. 10. In the illustrated embodiment, each cable end apart from the load bearing cable end is connected to an exercise station. However, one or both ends of the central cable 75 may be connected to a fixed tie-off on the frame, or to a moveable arm, providing only one or two 100% pull points rather than three as in FIG. 10. This may be appropriate for machines having less than five exercise stations, for example. Alternatively, one or both ends of the lower cable 82 may be connected to a fixed tie-off, providing one 200% pull point or only 100% pull points, as desired. In another possible alternative, one end of cable 75 and one end of cable 82 may be connected to a fixed tie-off. This arrangement would provide two 100% pull points and one 200% pull point. In another alternative, both ends of cable 75 and one end of cable 82 may be connected to fixed tie offs, providing one 100% pull point at the free end of cable 76 and one 200% pull point at the free end of cable 82.

In another possible alternative, the opposite end of cable 76 to the load may be connected to a fixed tie-off, with both ends of each of the cables 75 and 82 connected to exercise stations, or with one or more of these cable ends connected to fixed tie-offs, depending on the number and location of pull points required. The cable ends may alternatively be connected to a moveable arm rather than to a fixed tie-off.

The cable and pulley assembly of FIG. 10 therefore has great versatility, permitting any number of exercise stations from two to five to be connected to the assembly, in various combinations of 100% and 200% resistance as desired. The assembly is simple and compact, with only two floating pulley units linked in line without spreading sideways which is normally the case in systems involving four or more pull points or exercise stations.

Figure 11:
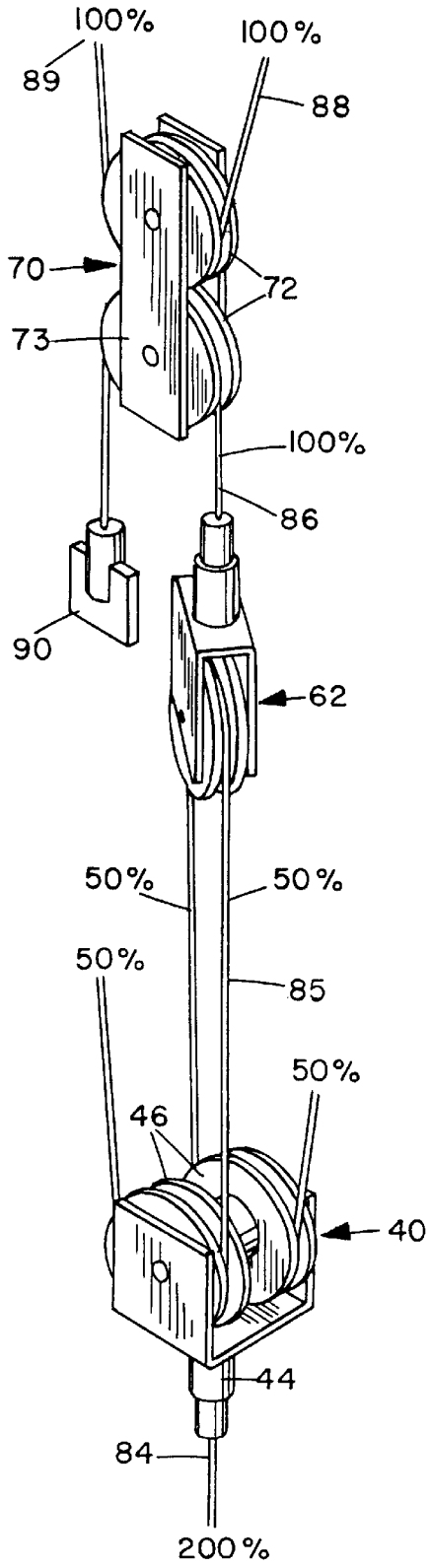
FIG. 11 is a perspective view of another embodiment of the cable and pulley system.

FIG. 11 illustrates another alternative cable and pulley assembly, which is similar to that of FIG. 9, combining the double, side-by-side pulley unit 40 with a double, vertically spaced pulley unit 70, but includes an additional, single floating pulley unit 62 between units 40 and 70. In this assembly, a first cable 84 is connected to the cable tie-off 44 of unit 40, a second cable 85 extends between unit 40 and the single floating pulley unit 62, a third cable 86 extends between unit 62 and the lowermost pulley 72 of unit 70, and a fourth cable 88 extends around the uppermost pulley 72 of unit 70.

In the illustrated embodiment, a number of pull points which are vertically spaced and in line are provided. One end 89 of cable 88 may be connected to a weight stack. The other end of cable 88 may be connected to an exercise station at a 1:1 resistance ratio (100% of load). Cable 86 has one end secured to the housing of single cable unit 62, and the opposite end is secured to a cable tie-off 90, which may be on the fixed frame of the exercise machine, or on a movable arm. Alternatively, the free end of cable 86 may be connected to an exercise station, and in this case it will have a 1:1 resistance ratio, or 100% of load.

The opposite ends of cable 85 may each be linked to exercise stations, and will each provide a 1:2 resistance ratio, or 50% of load. Alternatively, one or both ends of cable 85 may be connected to a cable tie-off mounted either on the fixed frame of the machine or on a movable arm. The end of cable 84 may be linked to an exercise station to provide a 2:1exercise ratio, or 200% of load.

The assembly of FIG. 11 provides an arrangement of three floating pulley units in line, one on top of the other, providing up to five pull points for appropriate connection or linkage to exercise stations, with resistance ratios of 1:1,2:1, and 1:2. In an alternative assembly (not illustrated), the double pulley unit 40 may be replaced with the triple pulley unit 50 of FIG. 4, providing one more pulling point, in an equivalent manner to FIGS. 7 and 10. In this case, a cable will pass around the lowermost pulley 54 of the triple pulley unit to provide two possible pull points at 100% of load each. One or more of the cable ends in this arrangement may also be selectively connected to a cable tie-off on the frame or a movable arm.

Figure 12:
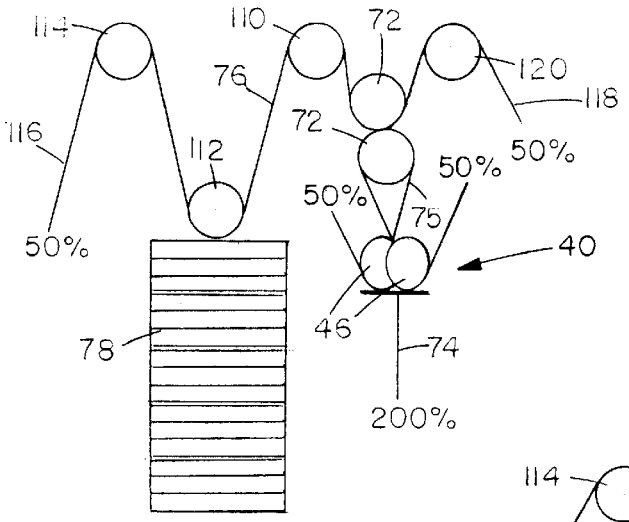
FIG. 12 is a schematic side elevation view illustrating one alternative for linking the cable and pulley assembly of FIG. 8 to a weight stack.

FIG. 12 schematically illustrates a side-by-side pulley unit 40 in an arrangement as illustrated in FIG. 8, and like reference numerals have been used for like parts as appropriate, and indicates one possible arrangement for linking cable 76 to a weight stack 78. In the arrangement of FIG. 12, the third cable 76 linked to the weight stack 78 via a series of pulleys 110,112,114, with pulley 112 rotatably mounted at the top of the weight stack. This leaves one end 116 of the cable free for providing another exercise pull point. The opposite end 118 of the cable 76 extends around a further pulley 120 and may also be linked to an exercise station. This arrangement provides the loads as indicated at the various pulling points. It will be understood that any of the five free cable ends illustrated in FIG. 12 may selectively be attached to the frame, to a single pulley, or continue on to an exercise station.

Figure 13:
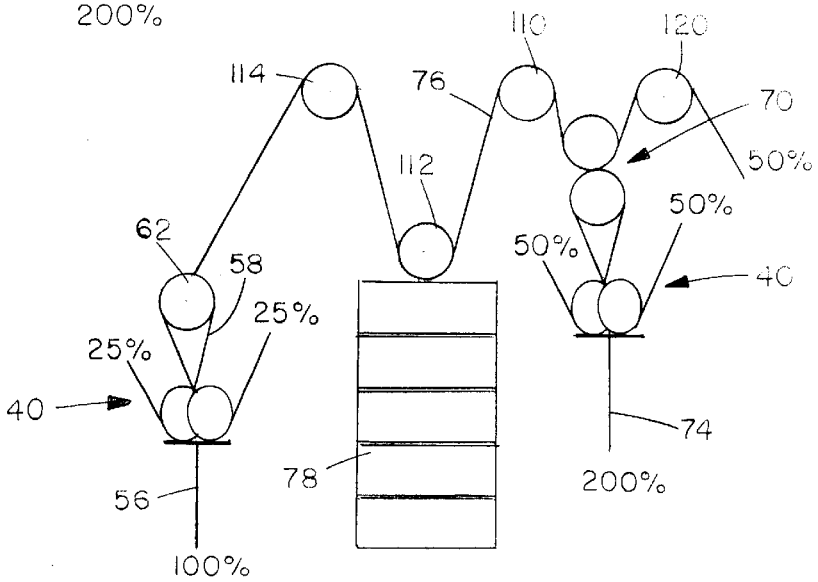
FIG. 13 is a schematic view similar to FIG. 12 illustrating addition of another cable and pulley assembly to provide extra pulling points.

FIG. 13 illustrates a modification of the assembly of FIG. 12, in which an additional side-by-side pulley unit 40 is linked to the cable 76 on the opposite side of weight stack 78. The pulley unit 40 on the left hand side of the weight stack as viewed in FIG. 13 is linked to a single floating pulley 62 in an arrangement similar to that illustrated in FIG. 5, and like reference numerals to those used in FIGS. 5, 8, and 12 have been used for like parts as appropriate.

In the arrangement of FIG. 13, the cable 76 continues on from single pulley 114 on the opposite side of the weight stack to pulley units 40 and 70, and is linked to the housing of single floating pulley 62 as illustrated. This provides additional pulling points at various different percentages of the weight stack load, which may be used at different exercise stations. In FIG. 13, a total of seven possible pulling points is provided.

Figure 14:
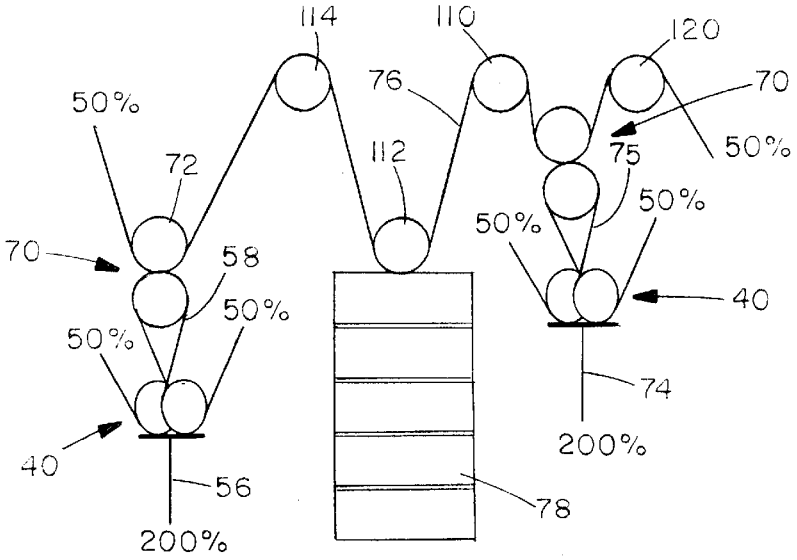
FIG. 14 illustrates a modification of the assembly of FIG. 13.

FIG. 14 illustrates a modification of the assembly of FIG. 1 3, in which the single floating pulley 62 on the left hand side of the weight stack is replaced with a double floating pulley unit 70, as on the right hand side. In this case, cable 76 wraps around the upper pulley 72 of pulley unit 70 and continues on for selective connection to an exercise machine frame, a further exercise station, or another single pulley. This arrangement provides eight possible pulling points with the indicated loads at the various cable ends.

Figure 15:
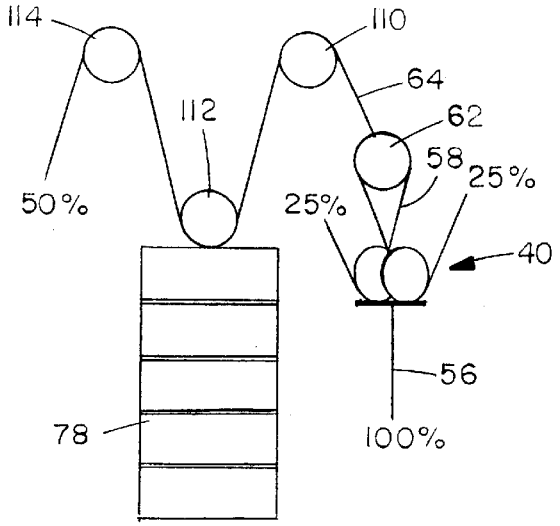
FIG. 15 is a schematic side elevation view of the cable and pulley assembly of FIG. 5 linked to a weight stack.

FIG. 15 illustrates an assembly similar to that of FIG. 12 but with the side-by-side pulley unit 40 linked to a single floating pulley unit 62 in an arrangement similar to that of FIG. 5. The cable 64 secured to the housing of the single pulley unit 62 extends around pulleys 110,112, and 114, with pulley 112 being rotatably mounted at the upper end of weight stack 78. Thus, cable 64 is linked to the weight stack while still providing a potential pulling point for linking to another exercise station, a cable tie off on the frame of the exercise machine, or a further pulley.

Figure 16:
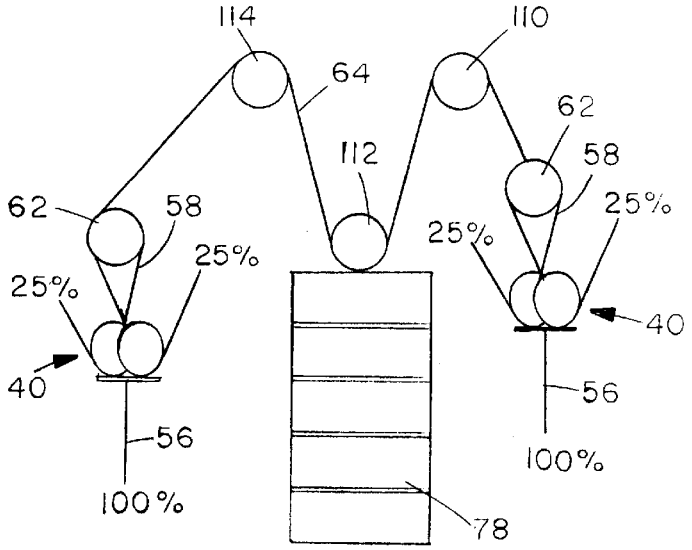
FIG. 16 illustrates a modification of FIG. 15 in which two cable and pulley assemblies are linked to the weight stack.

FIG. 16 illustrates a modification of the assembly of FIG. 15 in which an additional side-by-side pulley unit 40 is linked to a single pulley unit 62 as in FIG. 5, and the housing of the second pulley unit 62 is linked to the end of cable 64, providing an additional three pulling points. Thus, in FIG. 16, a cable 64 extends from the first single pulley unit 62 on one side of the weight stack, around pulleys 110,112, and 114, and is then linked to the second single pulley unit on the opposite side of the weight stack.

Figure 17:
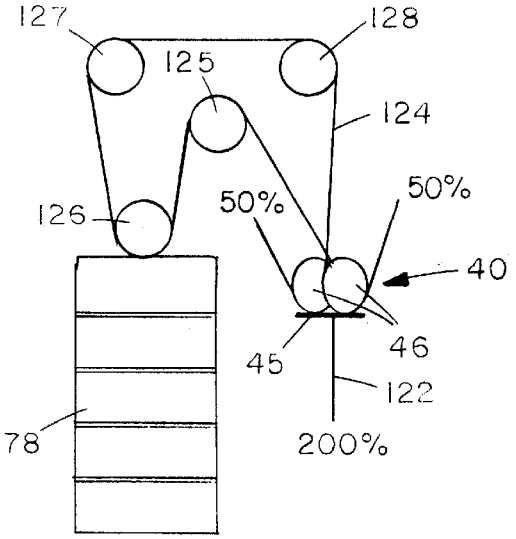
FIG. 17 is a schematic side elevation view of a modified cable and pulley assembly with one side-by-side pulley unit linked directly to a weight stack.

FIG. 17 illustrates another possible configuration of a cable and pulley assembly using a side-by-side pulley unit 40. In this configuration, a first cable 122 is linked to the housing 45 of the pulley unit 40. A second cable 124 engages the load or weight stack 78 and feeds the side-by-side pulleys 46. Cable 124 extends around one of the side-by-side pulleys 46, then around a sequence of four single pulleys 125,126,127,128 before extending around the other pulley 46 of the floating pulley unit 40. Pulley 126 is rotatably mounted on top of the weight stack 78, or may be suitably linked to the weight stack via an additional cable (not illustrated). This provides three possible pulling points at the indicated load percentages.

Figure 18:
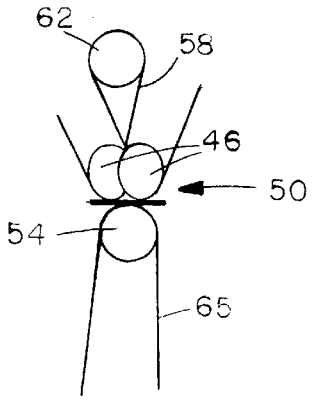
FIG. 18 is a schematic side elevation view of an alternative side-by-side pulley unit which may replace any of the side-by-side pulley units illustrated in FIGS. 12 to 17.

FIG. 18 is a schematic illustration of the side-by-side pulley unit 50 of FIG. 4 which has two side-by-side pulleys 46 and a third pulley 54 mounted on the housing beneath pulleys 46. The cable 58 extending around pulleys 46 is shown extending around a single floating pulley in a pulley unit 62, as also illustrated in FIG. 6. It will be understood that any of the side-by-side, two pulley units 40 of FIGS. 12 to 17 may be replaced with a three pulley unit 50 as illustrated in FIG. 18 in alternative configurations. Additionally, it will be understood that any cable end may attach to the frame, to a single floating pulley, or extend on to an exercise station.

The cable and pulley assembly of this invention requires less pulleys and pulley housings to provide a plurality of possible pull points at varying resistance ratios of 1:2, 1:1, 2:1, and 4:1. The design is relatively compact, since two or more floating pulley units are positioned in line on top of one another, instead of spreading out sideways as in prior art arrangements.

This provides a much less bulky and more pleasant appearance in the machine. The assembly can provide a resistance ratio of up to 4:1, as in FIGS. 8 and 9, and can provide two, three, four, five or six pull points for linking to various exercise stations, as desired. A combination of the pulley unit 50 in the arrangement of FIG. 12 provides six pulling points, and with FIG. 14 provides ten pulling points. A number of the alternatives provide two 2:1 resistance cables or pull points in a single floating pulley, such as the assembly of FIG. 10. This invention provides a double, side-by-side pulley unit or triple floating pulley unit in combination with at least one additional floating pulley unit in a large number of different possible configurations. Additionally, the triple floating pulley unit 50 provides more pulling points from a single location than was possible in any prior art arrangement.

It will be understood that the alternative cable and pulley assemblies of FIGS. 5 to 18 are just some of the possible configurations which may be obtained by combining the floating pulley unit 40 and/or 50 with other single or double pulley units. The double, side-by-side pulley unit 40 in combination with a cable fed around both pulleys provides two pulling points with the original resistance, and a third pulling point with four times the original resistance (see FIG. 8 and 9), or in the triple unit of FIG. 4, two pulling points with two times the original resistance (e.g. FIG. 10).

The side-by-side pulley unit of this invention, in combination with a cable that feeds around both of the side-by-side pulleys, gives more pulling points and the ability to perform more exercises off a single load or weight stack. Numerous possible variations are possible, depending on what resistance is desired at each of the pulling points, and combinations with pulling points at various different resistances are possible.

Although some preferred embodiments of the invention have been described above by way of example only, it will be understood by those skilled in the field that modifications may be made to the disclosed embodiments without departing from the scope of the present invention, which is defined by the appended claims.

I claim:

1. An exercise machine, comprising:

a load for providing exercise resistance;

a plurality of exercise stations;

a first floating pulley unit having a pulley housing and a pair of pulleys rotatably mounted side-by-side in the housing for rotation about a single pulley axis, the first pulley unit having a first side facing in a first direction transverse to said pulley axis and a second side facing in a second direction opposite to said first direction;

a second floating pulley unit having a pulley housing and at least one pulley rotatably mounted in the housing, the second floating pulley unit being spaced in said second direction from the first pulley unit;

a first cable linked to the housing of the first floating pulley unit on the first side of said first floating pulley unit;

a second cable linked to the housing of the second floating pulley unit; and a third cable extending first around a first one of the side-by-side pulleys in the first pulley unit, then directly from said one side-by-side pulley around the pulley of the second pulley unit, and then directly from the pulley of the second pulley unit around a second one of the side-by-side pulleys of the first pulley unit, whereby a first length of said first cable extends up to said first side-by-side pulley, a second length of said first cable extends from said first side-by-side pulley to the pulley of the second pulley unit, a third length of said first cable extends from said pulley of said second pulley unit to the second side-by-side pulley, and a fourth length of said first cable extends from said second side-by-side pulley, each of said lengths of said third cable being located on the second side of said first pulley unit; and said first and fourth lengths of said third cable, and lengths of said first and second cables are selectively linked to said load and exercise stations.

2. The assembly as claimed in claim 1, wherein the second cable is linked to the load and at least one end of the first cable and both ends of the third cable are linked to exercise stations.

3. The assembly as claimed in claim 1, wherein the second cable is linked to the load and at least one end of the first cable and one end of the third cable are linked to exercise stations, and the other end of the third cable is connected to a cable tie-off.

4. The assembly as claimed in claim 1, wherein the second cable is linked to the load, at least one end of the first cable is linked to an exercise station, and both ends of the third cable are connected to a cable tie-off.

5. The assembly as claimed in claim 1, wherein the first pulley unit has a third pulley pivotally secured to the pulley housing beneath the side-by-side pulleys for rotation about a third pulley axis, and the first cable extends around the third pulley to provide two cable lengths for selective linking to exercise stations.

6. The assembly as claimed in claim 5, wherein both lengths of the first cable are linked to exercise stations and one length of the second cable is linked to a load.

7. The assembly as claimed in claim 6, wherein both lengths of the third cable are linked to exercise stations.

8. The assembly as claimed in claim 6, wherein one length of the third cable is linked to an exercise station and the other of the third cable is linked to a cable tie-off.

9. The assembly as claimed in claim 5, wherein one length of the first cable is linked to an exercise station and the other length of the first cable is linked to a cable tie-off, and one length of the second cable is linked to a load.

10. The assembly as claimed in claim 9, wherein both lengths of the third cable are linked to exercise stations.

11. The assembly as claimed in claim 9, wherein one length of the third cable is linked to an exercise station and the other length of the third cable is linked to a cable tie-off.

12. The assembly as claimed in claim 1, wherein the second floating pulley unit has an upper pulley and a lower pulley pivotally mounted in the housing in a vertically spaced arrangement, the second cable extending around the upper pulley and the third cable extending around the lower pulley of the second floating pulley unit, whereby at least five cable lengths are provided for selective linking to a load and exercise stations.

13. The assembly as claimed in claim 12, wherein one length of the second cable is linked to a load and the first cable has a 4:1 resistance ratio with the load.

14. The assembly as claimed in claim 13, wherein the other length of the second cable is linked to an exercise station.

15. The assembly as claimed in claim 13, wherein the other length of the second cable is linked to a cable tie-off.

16. The assembly as claimed in claim 13, wherein both lengths of the third cable are linked to exercise stations.

17. The assembly as claimed in claim 13, wherein one length of the third cable is linked to an exercise station and the other length of the third cable is linked to a cable tie-off.

18. The assembly as claimed in claim 13, wherein the first pulley unit has a third pulley pivotally secured to the pulley housing beneath the side-by-side pulleys for rotation about a third pulley axis, and the first cable extends around the third pulley to provide two cable lengths each having a 2:1 resistance ratio for selective connection to exercise stations.

19. The assembly as claimed in claim 1, wherein a third floating pulley unit is connected to the second floating pulley unit in a vertically stacked arrangement, the second cable extending between the second and third pulley units, the third floating pulley unit having at least one pulley and a fourth cable extending around said one pulley of the third pulley unit, whereby at least five cable ends are provided for selective connection to a load and exercise stations.

20. The assembly as claimed in claim 19, wherein one end of said fourth cable is connected to a load.

21. The assembly as claimed in claim 20, wherein the other end of said fourth cable is connected to an exercise station.

22. The assembly as claimed in claim 21, wherein at least one end of the third cable and one end of the first cable are each connected to an exercise station.

23. The assembly as claimed in claim 19, wherein the third floating pulley unit has an upper pulley and a lower pulley pivotally mounted in the housing in a vertically spaced arrangement, the fourth cable extending around the upper pulley and the second cable extending around the lower pulley of the third floating pulley unit.

24. An exercise machine, comprising:

a load for providing an exercise resistance;

at least two exercise stations;

a cable and pulley assembly linking the load and exercise stations;

the cable and pulley assembly comprising:

a first floating pulley unit having a pulley housing and a pair of pulleys rotatably mounted side-by-side in the housing for rotation about a single pulley axis, the first floating pulley unit having a first side facing in a first direction transverse to said pulley axis and a second side facing in a second direction opposite to said first direction and transverse to said pulley axis;

a first cable linked to the pulley housing on the first side of said pulley unit;

at least one additional pulley on the second side of the pulley unit spaced from the first pulley unit;

a second cable extending in a predetermined cable path on the second side of the pulley unit extending around at least one of the side-by-side pulleys, then directly from said one side-by-side pulley around the additional pulley, and then directly from the additional pulley and around the other side-by-side pulley;

one of said cables being linked to said load and the cables including at least two cable lengths linked to said exercise stations; and including a second floating pulley unit having a pulley housing, said additional pulley comprising a pulley rotatable mounted in said pulley housing, and a third cable linked to the housing of the second floating pulley unit, whereby the second cable has at least four lengths of cable on the second side of said first floating pulley unit, the cable lengths comprising a first length of said second cable extending up to said first side-by-side pulley, a second length of said second cable extending from said first, side-by-side pulley to the pulley of the second pulley unit, a third length said second cable extending from sand pulley said second pulley unit to the second side-by-side pulley, and a fourth length of said second cable extending from said second side-by-side pulley.

25. The machine as claimed in claim 24, including a third exercise station, the third cable linking said second cable to the load, and the first cable and opposite ends of the second cable being linked to respective exercise stations.

26. The machine as claimed in claim 24, including a series of cable guide pulleys spaced from the first floating pulley unit on the second side of the pulley axis, one of the cable guide pulleys being linked to said load, the second cable extending in said cable path from one of said side-by-side pulleys, around said series of cable guide pulleys, and around the other of said side-by-side pulleys.

27. The machine as claimed in claim 24, including a second floating pulley unit having a second pulley housing and a second pair of pulleys rotatably mounted side by side in the second pulley housing for rotation about a second pulley axis, the second floating pulley unit having first and second sides on opposite sides of said second pulley axis, a third cable linked to the second pulley housing on the first side of the second pulley axis, a second additional pulley spaced from the second floating pulley unit, and a fourth cable extending on the second side of the second pulley axis around one of the second pair of pulleys, the second additional pulley, and the other pulley of the second pair, one of said third and fourth cables being linked to said load.

28. The machine as claimed in claim 27, including a load engaging pulley linked to said load, and a fifth cable extending from one of said additional pulleys, around said load engaging pulley and to the other additional pulley.

29. The machine as claimed in claim 28, including third and fourth floating pulley units, said additional pulley being rotatably mounted on said third floating pulley unit and said second additional pulley being rotatably mounted on said fourth floating pulley unit, one end of said fifth cable being secured to said third floating pulley unit and the other end of said fifth cable being secured to said fourth floating pulley unit.

30. The machine as claimed in claim 24, including a series of cable guide pulleys spaced from the first floating pulley unit on the second side of the pulley axis, one of the cable guide pulleys being linked to said load, the third cable extending in a cable guide path from said second floating pulley unit and around said cable guide pulleys.

31. The machine as claimed in claim 30, wherein one end of said first cable, both ends of said second cable, and one end of said third cable are linked to exercise stations.

32. An exercise machine, comprising:

a load for providing an exercise resistance;

at least one exercise station;

a cable and pulley assembly linking the load and exercise stations;

the cable and pulley assembly comprising:

a first pulley unit having a pair of pulleys rotatably mounted in parallel planes co-axially for rotation about a single, common pulley axis, the first pulley unit having a first side facing in a first direction transverse to said pulley axis and a second side facing in a second direction opposite to said first direction, and being connected to said load;

at least one additional pulley on the second side of the first pulley unit and spaced in said second direction from the first pulley unit;

a first cable extending in a predetermined cable path on the second side of the pulley axis, the cable path extending around one of the side-by-side pulleys, then directly from the one side-by-side pulley to the additionally pulley, then directly from the additional pulley to the other side-by-side pulley, at least one end of said first cable being linked to said exercise station; and the additional pulley comprising a second, floating pulley unit having a housing, said additional pulley comprising a pulley rotatably mounted in said housing, and a second cable is linked to said housing of said second pulley unit.

33. The machine as claimed in claim 32, including a series of cable guide pulleys spaced from the first pulley unit on the second side of the pulley axis, one of the cable guide pulleys being connected to said load, the second cable extending in a cable guide path from said second floating pulley unit and around said cable guide pulleys.

34. The machine as claimed in claim 32, wherein said one end of said first cable has a resistance which is different from the load resistance by a factor of at least two.

35. The machine as claimed in claim 34, wherein said one end of said first cable has a resistance which is different from the load resistance by a factor of four.

36. The machine as claimed in claim 35, wherein the ratio of the load resistance to the resistance at said one cable end is 4:1.

37. The machine as claimed in claim 32 including at least two exercise stations, opposite ends of said first cable being linked to said exercise stations.

38. The machine as claimed in claim 37, wherein each end of said first cable has a resistance which is different from the load resistance by a factor of at least two.

39. The machine as claimed in claim 38, wherein each end of said first cable has a resistance which is different from the load resistance by a factor of four.

40. The machine as claimed in claim 39, wherein the ratio of the load resistance to the resistance at each cable end is 4:1.

41. The machine as claimed in claims 32, wherein said first cable is located entirely on said second side of said first pulley unit.

42. The machine as claimed in claim 32, wherein said first cable has a first length extending up to said one side-by-side pulley, a second length extending from said one side-by-side pulley to said additional pulley, a third length extending from said additional pulley to said other side-by-side pulley, and a fourth length extending from said other side-by-side pulley, all four lengths of cable being located on said second side of said first pulley unit.

43. The machine as claimed in claim 32, wherein said first pulley unit has a housing, said pair of pulleys being rotatably mounted in said housing, and one end of said first cable has a resistance which is different from a resistance on said housing of said first pulley unit at the first side of said first pulley unit by a factor of at least two.

44. The machine as claimed in claim 43, wherein said one end of said first cable has a resistance which is different from the resistance on said housing of said first pulley unit at the first side of said first pulley unit by a factor of at least four.

45. The machine as claimed in claim 44, wherein the ratio of the resistance on said housing to the resistance at said one cable end is 4:1.

* * * * *

UNITED STATES PATENT AND TRADEMARK OFFICE

CERTIFICATE OF CORRECTION

PATENT NO. : 6,338,701 B1
DATED : January 15, 2002
INVENTOR(S) : Webber, Randall T.

It is certified that error appears in the above-identified patent and that said Letters Patent is hereby corrected as shown below:

Column 12,
Line 22, “rotable” should be changed to -- rotably --.
Line 29, before “side” and after “first”, delete “,”.
Line 30, before “said” and after “length”, insert -- of --.
Line 21, “sand” should be changed to -- said --.
Line 31, before “said and after “pulley”, insert -- of --.

Column 13,
Lines 32-33, “additionally” should be changed to -- additional --.

Signed and Sealed this

Fourth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,338,701 B1
DATED : January 15, 2002
INVENTOR(S) : Webber, Randall T.

It is certified that error appears in the above-identified patent and that said Letters Patent is hereby corrected as shown below:

Column 12,
Line 22, “rotable” should be changed to -- rotably --.
Line 29, before “side” and after “first”, delete “,”.
Line 30, before “said” and after “length”, insert -- of --.
Line 31, “sand” should be changed to -- said --.
Line 31, before “said and after “pulley”, insert -- of --.

Column 13,
Lines 32-33, “additionally” should be changed to -- additional --.

This certificate supersedes Certificate of Correction issued June 4, 2002.

Signed and Sealed this

Tenth Day of September, 2002

*Attest:*

*Attesting Officer*

JAMES E. ROGAN
*Director of the United States Patent and Trademark Office*